US006554915B2

(12) United States Patent
McCormick

(10) Patent No.: US 6,554,915 B2
(45) Date of Patent: Apr. 29, 2003

(54) DISSOLUTION OF NICKEL IN NON-OXIDIZING AQUEOUS ACID SOLUTIONS

(75) Inventor: David R. McCormick, Clawson, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/759,554

(22) Filed: Jan. 12, 2001

(65) Prior Publication Data

US 2002/0007873 A1 Jan. 24, 2002

Related U.S. Application Data

(60) Provisional application No. 60/176,367, filed on Jan. 14, 2000.

(51) Int. Cl.[7] ..... C22B 3/06

(52) U.S. Cl. ..... 148/243; 148/253; 148/956; 75/743; 75/956; 134/41; 423/150.1; 423/150.3

(58) Field of Search ..... 148/901, 243, 148/253; 75/743, 958; 423/150.1, 150.3; 134/41

(56) References Cited

U.S. PATENT DOCUMENTS 2,716,588 A * 8/1955 Hall ..... 134/41
3,104,167 A * 9/1963 Cotteta ..... 134/41
4,459,216 A * 7/1984 Nakazato et al. ..... 252/79.4
4,554,049 A * 11/1985 Bastenbeck ..... 156/656
5,993,635 A * 11/1999 Hourn et al. ..... 205/568

* cited by examiner

*Primary Examiner*—Roy King
*Assistant Examiner*—Tima McGuthry-Banks
(74) *Attorney, Agent, or Firm*—Stephen D. Harper; Arthur G. Seifert

(57) ABSTRACT

Fairly pure metallic nickel may be efficiently dissolved in non-oxidizing acid. If the nickel includes individual pieces longer than 0.5 mm in any linear dimension, oxidizing agent is preferably added from the beginning of dissolution, while if the nickel is powdered so that no single piece has a linear dimension longer than 0.35 mm, oxidizing agent is preferably added only after most of the originally supplied nickel has been dissolved. After oxidizing agent is added, most or all of the remaining undissolved nickeliferous solid will then dissolve. The temperature of the reaction mixture of acid liquid and solid nickel preferably is room temperature at the beginning of dissolution but is raised in steps to a final value of at least 65° C. and maintained at that temperature for several hours.

22 Claims, No Drawings

DISSOLUTION OF NICKEL IN NON-OXIDIZING AQUEOUS ACID SOLUTIONS

CROSS-REFERENCE TO RELATED APPLICATIONS

Priority for this application is claimed under 35 U.S.C. §119(e) from Application Serial No. 60/176,367 filed Jan. 14, 2000.

STATEMENT REGARDING FEDERALLY SPONSORED RESEARCH OR DEVELOPMENT

Not applicable.

BACKGROUND OF THE INVENTION

This invention relates to preparation of what at least initially are aqueous solutions of nickel salts. It is known that in thermodynamic principle such solutions can be prepared by dissolving metallic nickel in aqueous solutions of acids, but it is also known that in practice such reactions are often impractically slow in most non-oxidizing acids and even in some oxidizing acids under certain conditions, under which the phenomenon known as "passivity" occurs.

Nickel cations dissolved in water (along with some counterions) are an important constituent of many of the important types of liquid metal surface treatment chemical compositions that are known as "conversion coating solutions" or a like term and are fundamentally characterized by their ability to react with surfaces of many corrosion prone metals to form on the metal surfaces a solid coating layer that includes anions from the conversion coating solution and at least some cations derived from the metal coated and that improves the corrosion resistance and/or lubricant carrying capacity of the surface so coated.

Dissolved nickel cations could of course be supplied to aqueous solutions desired to contain them by dissolving a water soluble nickel salt. However, all such salts that are readily available at an economically reasonable price are hydrated and are susceptible to various degrees of hydration dependent on the conditions under which they are stored. It is therefore difficult under large-scale manufacturing conditions to obtain reliable amounts of nickel from these salts without the inconvenience and expense of frequent chemical analysis to quantify their nickel content. Aqueous solutions with known and consistent concentrations of nickel cations are accordingly preferred, and a major object of this invention is to provide such solutions at an economically acceptable cost.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that:

- if metallic nickel is in large pieces, it will dissolve within a few hours in non-oxidizing acid aqueous solutions only if an oxidizing agent that is chemically different from the non-oxidizing acid is present in the non-oxidizing acid aqueous solutions in a substantial concentration;
- if metallic nickel is in sufficiently finely divided powder form, most of the nickel will dissolve within a few hours in a non-oxidizing aqueous acidic solution that does not contain any separate oxidizing agent; much of any residual material will then dissolve within a few more hours if oxidizing agent is added to the aqueous acid solution in contact with the still-undissolved residue from the nickel powder;
- metallic nickel derived from decomposition of nickel carbonyl is sufficiently pure to be satisfactory as a source of nickel cation solutions for conversion coating;
- either large or small particles of nickel derived from decomposition of nickel carbonyl leave some insoluble residue when dissolved in aqueous non-oxidizing acid solutions, but when this residue is separated by filtration, the resulting solutions are satisfactory sources of nickel cations for high quality conversion coating solutions.

Accordingly, a process according to the invention comprises, preferably consists essentially of, or more preferably consists of, at least the following operations:

(I) providing a first mass of a solid, predominantly elemental nickel reagent;

(II) providing, separately from said first mass, a second mass of a precursor aqueous acidic liquid reagent that comprises, preferably consists essentially of, or more preferably consists of the following components:

(A) water;

(B) molecules of at least one non-oxidizing acid; and, optionally, one or both of the following components:

(C) an oxidizing agent component that contains molecules of at least one oxidizing agent that is distinct from said non-oxidizing acid; and (D) dissolved nickel cations; and (III) effecting contact between said first mass and said second mass under such conditions of temperature and relative motion between said two masses as will result in spontaneous chemical reaction between them, said spontaneous chemical reaction converting at least, with increasing preference in the order given, 80, 90, 95, or 98 percent of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than, with increasing preference in the order given, 24, 20, 16, 12, or 10 hours.

DETAILED DESCRIPTION OF THE INVENTION AND PREFERRED EMBODIMENTS

Suitable and preferred non-oxidizing acids for use in a process according to this invention are formic, acetic, sulfuric, hydrochloric, hydrobromic, hydriodic, hydrofluoric, phosphorous and condensed phosphorous, and phosphoric and condensed phosphoric acids. At least for economy when preparing phosphate conversion coating solutions, orthophosphoric acid is most preferred.

The solid, predominantly nickel reagent (hereinafter usually more briefly described as "nickeliferous solid") used as a starting material in a process according to the invention preferably contains at least, with increasing preference in the order given, 98.0, 99.0, 99.2, 99.4, or 99.6 percent by weight of nickel and independently contains minimal amounts, as specified in detail below, of the following elements, with preferences being independent for each element:

not more than, with increasing preference in the order given, 10,000, 5000, 3000, 2500, 2000, 1500, 1250, 1000, or 750 parts of oxygen per million parts by weight of the starting nickeliferous solid, this unit of concentration being hereinafter freely applied to any other constituent of any composition and being hereinafter usually abbreviated as "ppm";

not more than, with increasing preference in the order given, 7500, 5000, 3000, 2500, 2000, 1500, 1250, 1000, 800, 700, or 650 ppm of carbon;

not more than, with increasing preference in the order given, 100, 80, 60, 50, 40, 30, 25, 19, 14, or 9 ppm of nitrogen;

not more than, with increasing preference in the order given, 50, 40, 30, 20, 15, 10, 8, 6, or 4 ppm of iron;

not more than, with increasing preference in the order given, 25, 20, 15, 10, 8, 6, 4, or 2 ppm of either of silicon and sodium;

not more than, with increasing preference in the order given, 15, 12, 10, 8, 6, 4, 2, or 1.0 ppm of any of boron, calcium, magnesium, and sulfur;

not more than, with increasing preference in the order given, 7, 5, 3, 2.0, 1.5, 1.0, 0.8, or 0.6 ppm of any of copper, gallium, and zinc;

not more than, with increasing preference in the order given, 3.0, 2.0, 1.5, 1.0, 0.8, 0.6, 0.4, or 0.2 ppm of any of aluminum, bismuth, cobalt, indium, lead, selenium, and thallium;

not more than, with increasing preference in the order given, 1.5, 1.0, 0.8, 0.6, 0.40, 0.30, 0.27, 0.24, 0.21, 0.18, 0.15, or 0.12 ppm of any of silver, arsenic, barium, beryllium, cadmium, chromium, manganese, molybdenum, phosphorus, antimony, tin, tellurium, titanium, or vanadium.

Nickel objects of any size can be used in a process according to the invention if sufficient oxidizing agent is supplied along with the nickel and acid used for dissolution. However, to minimize the consumption of oxidizing agent as is usually desired, the nickel used preferably is in the form of fine powder. More particularly, the volume percent of the powder retained or passed by channels of various diameters preferably conforms to the following conditions, independently for each but more preferably for any two or more of them, with greater preference the greater the number of the following conditions satisfied:

the volume percent retained by channels of 248 micrometers, (hereinafter usually abbreviated as "μm") is not more than, with increasing preference in the order given, 10, 5, 2.0, 1.0, 0.5, 0.2, 0.10, 0.05, 0.02, 0.005, 0.002, or 0.0005;

the volume percent passed by channels of 248 μm and retained by channels of 176 μm is not more than, with increasing preference in the order given, 10, 5, 4.0, 3.5, 3.0, 2.5, or 2.0;

the volume percent passed by channels of 176 μm and retained by channels of 124 μm is not more than, with increasing preference in the order given, 20, 15, 10, 9.0, 8.0, 7.0, 6.0, or 5.5;

the volume percent passed by channels of 124 μm and retained by channels of 88 μm is not more than, with increasing preference in the order given, 30, 25, 20, 15, 10, 9.0, 8.5, or 8.0;

the volume percent passed by channels of 88 μm and retained by channels of 62 μm is not more than, with increasing preference in the order given, 30, 25, 20, 15, 12, 10, or 9.0;

the volume percent passed by channels of 62 μm and retained by channels of 44 μm is not more than, with increasing preference in the order given, 50, 40, 30, 25, 20, 18, 16, 14, 12, or 10;

the volume percent passed by channels of 44 μm and retained by channels of 31 μm is not more than, with increasing preference in the order given, 50, 40, 30, 25, 20, 18, 16, 14, 13.0, 12.0, or 11.0;

the volume percent passed by channels of 31 μm and retained by channels of 22 μm is not more than, with increasing preference in the order given, 50, 40, 30, 25, 20, 18.0, 17.0, 16.0, 15.0, 14.0, or 13.0;

the volume percent passed by channels of 22 μm and retained by channels of 15.6 μm is not more than, with increasing preference in the order given, 50, 40, 30, 25, 20, or 18 and independently preferably is not less than, with increasing preference in the order given, 4, 6, 8, 10, or 12;

the volume percent passed by channels of 15.6 μm and retained by channels of 11.0 μm is not more than, with increasing preference in the order given, 50, 40, 30, 25, 21, or 19 and independently preferably is not less than, with increasing preference in the order given, 4, 6, 8, 10, or 11.5;

the volume percent passed by channels of 11.0 μm and retained by channels of 7.8 μm is not more than, with increasing preference in the order given, 50, 40, 30, 25, 21, 19 or 17 and independently preferably is not less than, with increasing preference in the order given, 2, 4, 6, 7.0, 8.5, 9.0, 9.4, or 9.7;

the volume percent passed by channels of 7.8 μm and retained by channels of 5.5 μm is not more than, with increasing preference in the order given, 30, 25, 22, 19, or 17 and independently preferably is not less than, with increasing preference in the order given, 2, 4, 5.0, 5.5, 6.0, 6.5, 7.0, or 7.3;

the volume percent passed by channels of 5.5 μm and retained by channels of 3.9 μm is not more than, with increasing preference in the order given, 30, 25, 22, 19, 16, 13, 10, 8.5, or 7.2;

the volume percent passed by channels of 3.9 μm and retained by channels of 1.9 μm is not more than, with increasing preference in the order given, 20, 15, 10, 8, 6.0, 5.0, 4.0, 3.5, or 3.0; and the volume percent not retained by channels of 1.9 μm is not more than, with increasing preference in the order given, 2.0, 1.0, 0.5, 0.2, 0.10, 0.05, 0.02, 0.005, 0.002, or 0.0005.

(It should be noted that the sizes of the "channels" as cited in the paragraphs immediately next above are part of a standardized test method generally used by suppliers of nickel powder. There is no intended implication that the channel sizes correspond precisely to particle sizes that might be measured by other methods, such as micrographic analysis of individual particles. On the contrary, it is widely believed that the sizing of particles by passage through these channels gives larger size values than would be found in a hypothetical "perfect" method of particle size analysis, because of the possibilities of agglomerations of particles that are not broken up by their passage through the test channels, variations in the orientation of non-equiaxed particles with respect to the direction of passage through the channels, and the like. These over-estimates of size can be quite substantial. For example, a powder specified by its supplier to have an average size of about 50 μm, using the channel passage method, produces scanning electron micrographs in which most of the particles appear to be about 8 μm in size.)

When an oxidizing agent is used, it is preferably one that does not result in the addition of extraneous substances to the solution of nickel salt eventually prepared in a process according to the invention. Ozone and hydrogen peroxide both satisfy this preference, because the only residues from them after they function as oxidizing agents are water and gaseous oxygen, which is of course present in any liquid exposed to the natural atmosphere. Because it is far more conveniently available than any other known oxidizing agent that is free from extraneous residues, hydrogen peroxide is most preferred.

The quantity of hydrogen peroxide preferred and its preferred time of use depend on the size of the pieces and/or particles of nickeliferous solid materials used as the primary source of nickel in a process according to the invention. If any part of the nickeliferous solid that is reacted consists of pieces each longer in any dimension than 0.5 millimeter (this unit, in either singular or plural, being hereinafter usually abbreviated as "mm"), the hydrogen peroxide preferably is present from the beginning of reaction in the aqueous acidic solution reacted with the nickeliferous solid, and the amount of hydrogen peroxide so present depends only on the amount of nickeliferous solid reacted that does consist of pieces each longer in any dimension than 0.5 mm, nickeliferous solid that is in pieces of this size being hereinafter denoted as "non-powdery". The number of moles of hydrogen peroxide present from the beginning of reaction preferably has a ratio to the number of moles of non-powdery nickeliferous solid reacted that is at least, with increasing preference in the order given, 0.10:1.00, 0.20:1.00, 0.30:1.00, 0.40:1.00, 0.50:1.00, 0.60:1.00, 0.70:1.00, 0.80:1.00, 0.90:1.00, 1.00:1.00, or 1.1:1.00 and independently preferably, at least for economy, is not more than, with increasing preference in the order given, 3.0:1.00, 2.5:1.00, 2.2:1.00, 2.0:1.00, 1.8:1.00, 1.6:1.00, 1.5:1.00, 1.4:1.00, or 1.3:1.00.

In contrast, if at least, with increasing preference in the order given, 95, 97, or 99 percent of the nickeliferous solid reacted passes through channels with a diameter of at least, with increasing preference in the order given, 0.40, 0.30, or 0.25 millimeter, then no oxidizing agent at all is necessary in a process according to the invention. If hydrogen peroxide or another oxidizing agent is nevertheless used, as is generally preferred in order to convert as much as possible of the nickel in the nickeliferous solid to one or more dissolved nickel salts, the addition of oxidizing agent is preferably delayed until at least, with increasing preference in the order given, 75, 85, 95, or 97% of the mass of the nickeliferous solid brought into contact with acid in a process according to the invention has already dissolved, and the amount of oxidizing agent then added preferably is based on the amount of nickeliferous solid that remains undissolved. More particularly, the number of moles of hydrogen peroxide added preferably has a ratio to the number of moles of nickeliferous solid remaining undissolved, the number of moles of the nickeliferous solid being calculated for this purpose by assuming that the nickeliferous solid is pure nickel, that is at least, with increasing preference in the order given, 0.2:1.00, 0.4:1.00, 0.6:1.00, 0.80:1.00, 0.90:1.00, 0.95:1.00, 1.00:1.00, 1.05:1.00, or 1.10:1.00 and independently preferably, at least for economy, is not more than, with increasing preference in the order given, 10:1.00, 8:1.00, 6:1.00, 4:1.00, 2.0:1.00, 1.5:1.00, or 1.3:1.00. Oxidant may alternatively be added at any earlier stage even when all or substantially all of the nickeliferous solid consists of fine particles, but any such oxidant usually does not increase the reaction rate enough to justify the cost of the added oxidant.

If all or part of the oxidizing agent selected is not hydrogen peroxide, the number of moles stated in these immediately preceding preferences should be adjusted as needed, based on the number of electrons per molecule acquired by the other oxidizing agent(s) during its/their expected oxidizing reaction(s), so that the number of electrons transferred to the total oxidizing agent component will be the same as when the above-stated amounts of hydrogen peroxide are used as the only oxidizing agent. (Hydrogen peroxide is expected to transfer two electrons per mole according to the half-reaction equation $2H^+ + 2e^- + H_2O_2 \rightarrow 2H_2O$.)

(Some uses of the nickel salt solutions prepared could be damaged by the presence of residual peroxide in a solution made as described above when a molar excess of hydrogen peroxide over nickel is used. As is known to those skilled in the art, even a small excess of hydrogen peroxide can be conveniently detected by a starch-iodide test solution. If peroxide is found by this test in a sample of the prefiltered nickel salt solution made by a process according to this invention, it is recommended that the amount of residual peroxide be analytically determined and a sufficient amount of nickel powder to consume this peroxide be added to the solution before filtration.)

When a precursor aqueous acidic liquid with its sole or predominant (i.e., at least, with increasing preference in the order given, 60, 70, 80, 90, 95, or 99% of its) acid content consisting of one or more oxyphosphorus acids is reacted with a nickeliferous solid in a process according to this invention, the concentration of the acid, measured as its stoichiometric equivalent as orthophosphoric acid, in the precursor aqueous acidic liquid at the beginning of reaction preferably is at least, with increasing preference in the order given, 10, 20, 25, 30, 35, 38, or 41% and independently preferably is not more than, with increasing preference in the order given, 75, 65, 55, or 45%. The minimum concentration preference is to avoid uneconomically long reaction times, while the maximum concentration preference is to avoid at least one of excessive viscosity, inadequate solubility of the nickel salts formed in the acid solution, and any danger of explosion as a result of rapid generation of hydrogen. Furthermore and independently, the ratio of the mass of oxyphosphorus acid molecules, measured as their stoichiometric equivalent as orthophosphoric acid molecules, preferably has a ratio to the mass of nickel in the nickeliferous solid reacted with the oxyphosphorus acid molecules that is at least, with increasing preference in the order given, 1.0:1.00, 2.0:1.00, 3.0:1.00, 3.5:1.00, 4.0:1.00, 4.3:1.00, or 4.6:1.00 and independently preferably is not more than, with increasing preference in the order given, 10:1.00, 8:1.00, 7.0:1.00, 6.5:1.00, 6.0:1.00, 5.6:1.00, 5.2:1.00, or 4.8:1.00. The reasons for these preferences are substantially the same as for the analogous concentration preferences noted last above.

When a precursor aqueous acidic liquid with its sole or predominant (i.e., at least, with increasing preference in the order given, 60, 70, 80, 90, 95, or 99% of its) acid content consisting of hydrofluoric acid is reacted with a nickeliferous solid in a process according to this invention, the concentration of the acid in the precursor aqueous acidic liquid at the beginning of reaction preferably is at least, with increasing preference in the order given, 1.0; 3.0, 5.0, 6.0, 7.2, 7.4, or 7.6% and independently preferably is not more than, with increasing preference in the order given, 70, 60, 50, 40, 30, 20, 15, or 10%. The minimum concentration preference is to avoid uneconomically long reaction times, while the maximum concentration preference is to avoid at least one of excessive viscosity, inadequate solubility of the nickel salts formed in the acid solution, and any danger of explosion as a result of rapid generation of hydrogen. Furthermore and independently, the ratio of the mass of hydrofluoric acid molecules in the precursor aqueous acidic liquid preferably has a ratio to the mass of nickel in the nickeliferous solid reacted with the precursor aqueous acidic liquid that is at least, with increasing preference in the order given, 0.30:1.00, 0.50:1.00, 0.60:1.00, 0.70:1.00, 0.80:1.00, 0.90:1.00, or 1.00:1.00 and independently preferably is not more than, with increasing preference in the order given, 10:1.00, 5:1.00, 3.0:1.00, 2.0:1.00, 1.8:1.00, 1.6:1.00, 1.4:1.00, or 1.2:1.00. The reasons for these preferences are substantially the same as for the analogous concentration preferences noted last above.

The reaction between solid nickel and aqueous acidic liquid to form nickel salts that become dissolved in the aqueous acidic liquid normally generates hydrogen gas, most of which escapes from the liquid. When little or no oxidizing agent is present in the aqueous acidic liquid, the generation of hydrogen in a process according to the invention has been observed to be stoichiometrically equivalent to the amount of nickel dissolved according to the chemical reaction: $Ni+2H^{+}\rightarrow Ni^{+2}+H_2$. When the relative amounts of oxidizing agent preferred for dissolving large pieces of nickeliferous solid are present in the aqueous acidic liquid used in a process according to the invention, the amount of evolved hydrogen sometimes is substantially less than a stoichiometric amount according to the simple reaction equation above, but some gas almost always has been observed to be evolved even in the presence of large relative amounts of oxidizing agent. Hydrogen gas is, of course, flammable and potentially explosive when mixed with air, so that proper safety precautions, which will be known to those skilled in the art, should be taken against any corresponding hazard in a process according to the invention.

A "batchwise" process according to the invention is defined as one in which a single volume of aqueous acidic liquid is reacted with a specified volume of nickeliferous solid. The specified volume of solid can be mixed with the single volume of liquid either all at once at the beginning of the process, or the volume of solid can be divided into portions that are added one by one to the single volume of liquid, waiting until most of one portion of solid has dissolved before adding any additional portion of the solid. A batchwise process according to the invention is generally preferred for convenience on even a moderately large scale, up to at least a few thousand kilograms of nickel salt containing solution to be manufactured, although on a still larger scale a continuous process in which aqueous acidic liquid and nickeliferous solid are continuously input and product aqueous acidic solution of nickel salts is continuously output will become preferred.

The temperature at which a batchwise process according to the invention is performed preferably varies, most preferably monotonically, from an initial value that is at least, with increasing preference in the order given, 15, 20, or 22° C. and independently preferably is not more than, with increasing preference in the order given, 31, 29, or 27° C. to a final value that is at least, with increasing preference in the order given, 65, 68, 71, 74, or 76° C. and independently preferably is not more than, with increasing preference in the order given, 95, 90, 85, 80, or 77° C. If the temperature is too low, a very long reaction time will be required, while if the temperature is too high, foaming of the reaction mixture and related practical difficulties associated with generation of large volumes of gas in a short time are likely. As normally expected from general physical chemistry principles, at a constant temperature, the reaction rate in a process according to the invention is usually greatest when the aqueous acidic liquid reacted contains little or no dissolved nickel salts and decreases with increasing accumulation of nickel salts in the liquid, while at constant concentration of dissolved nickel salts and acid, the reaction rate increases with increasing temperature. It has accordingly been found necessary, in order to achieve an at least approximately optimal reaction rate throughout an entire batchwise process according to the invention, to raise the temperature as the aqueous acidic liquid becomes more concentrated in dissolved nickel cations. More particularly, when temperature control of the aqueous acidic liquid reacted is available as preferred, the temperature is, in one particularly preferred embodiment of the invention, raised from the initial value in increments that are at least, with increasing preference in the order given, 1.0, 1.5, 2.0, or 2.5° C. and independently preferably are not more than, with increasing preference in the order given, 25, 20, 15, 10, 7, 5, 4.5, 4.0, 3.5, or 3.0° C. and after the temperature target for each incremental increase has been attained, the temperature is not raised again by external heating for a time that is at least, with increasing preference in the order given, 2, 5, 8, 11, or 14 minutes and independently preferably, unless the temperature is at least 55° C., is not more than, with increasing preference in the order given, 55, 45, 35, 25, 20, or 16 minutes. After the aqueous acidic liquid has reached the final intended temperature, this temperature is preferably maintained for a time that is at least, with increasing preference in the order given, 1.0, 2.0, 3.0, 4.0, 5.0, or 5.9 hours and independently preferably is not more than, with increasing preference in the order given, 24, 20, 16, 12, 10, 8, or 6.1 hours. If oxidizing agent is desired and has not been previously added, it then is preferably added to the mixture at its intended final temperature, which preferably is maintained for another time interval that is at least, with increasing preference in the order given, 15, 25, 35, 45, or 55 minutes and independently preferably is not more than, with increasing preference in the order given, 4.0, 3.0, 2.0, 1.5, or 1.1 hours. The solution is then preferably cooled to a temperature that is not more than, with increasing preference in the order given, 50, 45, 40, 35, or 30° C. and independently preferably is not less than, with increasing preference in the order given, 20, 24, 27, or 29° C. and then filtered through a filter that retains particles as much as, with increasing preference in the order given, 10, 8, 6, 4, 2.0, 1.5, 1.0, or 0.5 μm in diameter. The solution is then ready for use.

In some of the uses of the nickel salt solutions prepared in a process according to this invention, the presence of even small quantities of some impurity elements can cause serious problems. It is therefore preferred that sufficiently pure reagents be used in a process according to the invention and introduction of contaminants be sufficiently well prevented that the product nickel salt solution will not contain more than, with increasing preference in the order given, 1000, 500, 200, 100, 50, 20, 18, 16, 14, 12, or 10 ppm of any of the following elements, the preference being independent for each element: Ag, Ti, Zr, Sn, Ca, Al, Mo, Sr, La, Ba, Si, Mn, Fe, Cr, Mg, V, Na, Be, B, Cu, Pb, Li, K, Rb, Cs, Fr, Ra, Sc, Cd, Zn, Ga, As, Se, Br, I, Te, Sb, In, Pd, Rh, Ru, Ce, Pr, Nd, Pm, Sm, Eu, Gd, Tb, Dy, Ho, Er, Tm, Yb, Y, Lu, Hf, Ta, W, Re, Os, Ir, Pt, Au, Hg, Tl, Bi, Po, Ac, Th, Pa, U, Np, Am, Cm, Bk, and Cf.

The invention may be further appreciated from the following examples and comparison examples.

EXAMPLE

Comparison Example Group 1

In each example and comparison example in this group, one or more nickel spheres that had masses from 2 to 12 grams each were used as the nickeliferous solid, and relative motion between the liquid and solid was provided by a magnetic stirring bar at the bottom of the container. The amount of nickel dissolved was determined by weighing the sphere(s) before and after attempted dissolution, unless the lack of any significant dissolution was indicated by the failure of any green color to develop in the liquid.

In Comparison Example 1.1, dissolution was attempted with 75% reagent grade orthophosphoric acid at normal ambient temperature (18–23° C.). Essentially no dissolution occurred after 24 hours, as indicated by failure of the liquid to develop a green color. In Comparison Example 1.2, liquid of the same composition as in 1.1 was used, but the temperature was raised to 60–90° C. In this experiment, there was sufficient dissolution to color the liquid green, but the weight of the nickel sphere changed so little that it was obvious it would take far more than 50 hours to dissolve the sphere completely. In Comparison Example 1.3, an attempt was made to catalyze the dissolution of the nickel with copper, which is capable of deposition plating on the nickel. Such plating of an electrochemically more noble metal sometimes facilitates the dissolution of a less noble metal on which it deposits. However, when 2.6 grams (hereinafter usually abbreviated as "g") of copper wire was added to the container holding a nickel sphere with a mass of 9 g and 51 g of 75% orthophosphoric acid maintained at 70–85° C., the copper wire eventually dissolved after 70 hours, but the mass of the nickel sphere did not change significantly. This result may, of course, be partially due to substitution of copper on the surface of the nickel, but it was nevertheless obvious that this type of catalysis by copper was not effective in dissolving the nickel sphere at a commercially viable rate. In Example 1.4, a nickel sphere that weighed 8.9 g initially was used together with a mixture of 51 g of 75% orthophosphoric acid solution in water and 31 g of 30% hydrogen peroxide solution in water, with the temperature maintained at 75–85° C. The liquid quickly became a clear green color, and after 9 hours half of the nickel sphere had dissolved.

In Examples 1.5 and 1.6, the aqueous acidic liquid was 51 g of 75% orthophosphoric acid mixed with 21 g of 30% hydrogen peroxide. In Example 1.5, 8 visually equally sized spheres with an average weight of 2.6 g each were used and the aqueous acidic liquid was maintained as near as possible to 100° C. in an open top container. In Example 1.6, 5 visually equally sized spheres with an average weight of 3.4 g each were used as the nickeliferous solid and the aqueous acidic liquid was maintained between 90 and 100° C. In Example 1.5, 10 g of nickel were dissolved in 6.2 hours, and in Example 1.6 the same amount of nickel required 10.2 hours to dissolve.

Example Group 2

In this group, nickel pellets in approximately spherical shapes with diameters from 5 to 15 millimeters were used as the nickeliferous solid. These pellets were supplied by International Nickel Corp. ("INCO") and were reported by their supplier to contain 99.97% of elemental nickel and to have the following upper limits, in ppm, of the following impurity elements: Co, 1.0; Fe, 60; S, 7.0; C, 100; Cu, 2.0; Zn, 0.5; and Pb, 0.2. Quantities of these nickel pellets were mixed with aqueous orthophosphoric acid at a molar ratio of acid to nickel of 2.8:1.00 and with hydrogen peroxide in the ratios shown in Table 1 below and maintained at the temperatures shown in Table 1 for 18–24 hours with constant mechanical mixing. The percentage of nickel dissolved during this time was also determined and is shown in Table 1. The results in this table indicate that with nickeliferous solid of this size, the fraction dissolved depends primarily on the amount of hydrogen peroxide contained in the aqueous acidic liquid contacted with the nickeliferous solid rather than the temperature of reaction.

Example Group 3

In this group, powdered nickel was used as the nickeliferous solid. The powder R used was INCO Type CGNP (for "Chemical Grade Nickel Powder"). Nine lots of this powder were reported by its supplier to have the particle size distributions shown in Table 2 below. This grade of powder was reported by its supplier to have maximum contents of various elements as shown in Table 3 below. 404 parts of deionized water were mixed with 516 parts of 75% $H_3PO_4$ solution in water in a container equipped with facilities for heating or cooling by means of a water jacket for the container. After 10 minutes of constant stirring of this mixture, the mixture had a temperature of 27° C. Then 83 parts of the nickel powder were added with stirring, the temperature after the addition of nickel being maintained at 27° C. for one hour. The temperature was then raised in increments of 2.8° C. to 38° C. During this period, the temperature controller was raised to a given temperature 15 minutes after having been raised to the immediately preceding temperature. After the temperature reached 38° C., it was maintained there for one hour. Then raising the temperature controller in increments of 2.8° C. at 15 minute time intervals was resumed and continued until the temperature reached 77° C. This temperature was maintained for 6.0 hours, then lowered to 29° C. After the temperature reached 29° C., 1.0 part of a 31.5% solution of hydrogen peroxide was added and mixed. The temperature was then raised again to 77° C., held at that temperature for 1.0.

TABLE 1

| Identifier | Moles $H_2O_2$/ Moles Ni | Temperature, ° C. | % of Solid Ni Dissolved |
|---|---|---|---|
| 2.1 | 0.60 | 55 | 58 |
| 2.2 | 0.60 | 75 | 61 |
| 2.3 | 0.60 | 95 | 59 |
| 2.4 | 0.95 | 75 | 90 |

TABLE 2

| Lot | Average Volume Fraction of This Lot That Was Retained by Channels Having the Following Sizes in μm, after Being Passed by Channels Having the Size in μm Heading the Column, If Any, Having the Next Higher Number: | | | | | | | |
|---|---|---|---|---|---|---|---|---|
| Number | 249 | 176 | 125 | 88 | 62 | 44 | 31 | 22 |
| 1 | 0.00 | 0.00 | 0.62 | 3.3 | 5.8 | 8.2 | 10.0 | 12.9 |
| 2 | 0.00 | 0.00 | 0.00 | 0.44 | 1.27 | 4.9 | 8.6 | 12.5 |
| 3 | 0.00 | 0.00 | 0.00 | 0.13 | 2.1 | 5.6 | 9.0 | 12.4 |
| 4 | 0.00 | 0.00 | 0.34 | 2.4 | 4.8 | 7.7 | 9.8 | 13.0 |
| 5 | 0.00 | 0.00 | 0.00 | 0.00 | 1.1 | 3.4 | 6.2 | 10.9 |
| 6 | 0.00 | 1.38 | 5.6 | 7.9 | 8.5 | 9.7 | 10.2 | 11.4 |
| 7 | 0.00 | 1.91 | 4.6 | 6.8 | 7.1 | 8.2 | 9.5 | 11.2 |
| 8 | 0.00 | 0.00 | 0.00 | 0.00 | 1.5 | 5.1 | 8.2 | 12.1 |
| 9 | 0.00 | 0.00 | 2.4 | 4.1 | 5.0 | 7.6 | 9.2 | 11.7 |

| Lot | Average Volume Fraction of This Lot That Was Retained by Channels Having the Following Sizes in μm, after Being Passed by Channels Having the Size in μm Heading the Column, If Any, Having the Next Higher Number: | | | | | | | |
|---|---|---|---|---|---|---|---|---|
| Number | 16 | 11 | 7.8 | 5.5 | 3.9 | 2.8 | 1.9 | 1.4 |
| 1 | 17.4 | 17.8 | 13.4 | 7.4 | 2.4 | 0.00 | 0.00 | 0.00 |
| 2 | 16.3 | 17.3 | 16.4 | 12.9 | 6.3 | 2.6 | 0.29 | 0.00 |
| 3 | 15.6 | 17.0 | 16.4 | 13.2 | 6.2 | 2.2 | 0.24 | 0.00 |
| 4 | 17.9 | 18.6 | 14.0 | 8.1 | 2.7 | 0.77 | 0.00 | 0.00 |
| 5 | 15.8 | 18.6 | 18.8 | 15.2 | 7.0 | 2.6 | 0.23 | 0.00 |
| 6 | 12.5 | 11.5 | 9.9 | 7.4 | 3.3 | 1.03 | 0.00 | 0.00 |
| 7 | 13.1 | 12.7 | 11.2 | 8.5 | 3.9 | 1.25 | 0.00 | 0.00 |
| 8 | 16.2 | 17.5 | 16.7 | 13.5 | 6.6 | 2.5 | 0.00 | 0.00 |
| 9 | 15.0 | 14.5 | 13.3 | 10.6 | 4.8 | 1.8 | 0.10 | 0.00 |

TABLE 3

| Maximum ppm in Powder of the Following Chemical Elements: | | | | | | | | |
|---|---|---|---|---|---|---|---|---|
| Ag | Al | As | B | Ba | Be | Bi | C | |
| <0.1 | 0.2 | <0.1 | <1 | <0.1 | <0.1 | <0.2 | $6 \times 10^2$ | |
| Ca | Cd | Co | Cr | Cu | Fe | Ga | In | Mg |
| <1 | <0.1 | <0.2 | <0.1 | <0.5 | 4 | <0.5 | <0.2 | <1 |

TABLE 3-continued

| Maximum ppm in Powder of the Following Chemical Elements: | | | | | | | | |
|---|---|---|---|---|---|---|---|---|
| Mn | Mo | N | Na | O | P | Pb | S | |
| <0.1 | <0.1 | 8 | <2 | $7 \times 10^2$ | <0.1 | <0.2 | 1 | |
| Sb | Se | Si | Sn | Te | Ti | Tl | V | Zn |
| <0.1 | <0.2 | <2 | <0.1 | <0.1 | <0.1 | <0.2 | <0.1 | <0.5 |

hour, and then cooled again to 29° C., at which temperature it was filtered through a filter that retains 0.5 μm particles. The filtrate was then ready for use as a source of nickel (and phosphoric acid) in a conversion coating formulation.

Example 4

In this example, hydrofluoric acid (and a small amount of sulfuric acid) were used instead of phosphoric acid to dissolve the nickel. The specific ingredients mixed were 10.5 g of a 35% solution of HF in water, 1.0 g of 98% sulfuric acid in water, 36.8 grams of deionized water, and 3.7 grams of the same type of INCO CGNP nickel powder as was used in Example Group 3. The mixture was constantly stirred, and the temperature, which was initially 25° C., was raised over a period of 45 minutes to a temperature of 75° C. Rates of hydrogen evolution, in standard cubic centimeters per minute, observed at some of the temperatures are shown in Table 4. These indicate rapid dissolution of the nickel at the higher temperatures in the Table.

TABLE 4

| | Temperature, ° C. | | | | | | | | |
|---|---|---|---|---|---|---|---|---|---|
| | 25 | 30 | 35 | 40 | 45 | 50 | 65 | 70 | 75 |
| $H_2$ Evolution Rate | 1.3 | 2.1 | 3.0 | 3.8 | 5.4 | 7.1 | 12.5 | 12.9 | 13.1 |

Example Group 5

The examples in this group were performed in the same manner as for Group 3, except that the amount of hydrogen peroxide used was varied. In addition, the amount of filtered solids, the nickel content of the filtered solids, and the magnetic or non-magnetic nature of the filtered solids were determined. (Elemental nickel is magnetic.) Some results are shown in Table 5, where the parts of hydrogen peroxide solution used were mixed with the same number of parts of other materials as in Group 3. These results indicate that addition of hydrogen peroxide does promote the dissolution of nickel from even the most slowly soluble parts of the nickel powder and that a relatively small amount of added hydrogen peroxide is sufficient to dissolve practically all of the nickel.

TABLE 5

| Parts of 31.5% $H_2O_2$ Added | Characteristics of the Resulting Nickel Salt Solution: Percent Nickel | Free Acid Points | Total Acid Points | Characteristics of the Filtered Solids: % of Total Amount of Nickel Powder Initially Used That Is: Wet Solids | Dry Solids | Nickel | % $H_2O$ in Wet Solids | Dry Solids Magnetic? |
|---|---|---|---|---|---|---|---|---|
| 0.00 | 8.08 | 6.7 | 37.6 | 2.6 | 2.15 | 1.54 | 17.3 | Yes |
| 2.25 | 8.26 | 6.3 | 36.9 | 1.24 | 0.07 | 0.007 | 94 | Yes |
| 2.50 | 8.30 | 6.2 | 36.9 | 1.36 | 0.16 | 0.038 | 88 | Yes |
| 2.75 | 8.34 | 6.3 | 36.9 | 1.17 | 0.05 | 0.0026 | 96 | No |

The invention claimed is:

1. A process for making a final aqueous acidic liquid that contains dissolved nickel cations, said process comprising the following operations:

(I) providing a first mass of a solid, predominantly elemental nickel reagent, comprising a non-powdery mass in which each individual piece of said predominantly elemental nickel reagent is longer than about 0.5 mm in at least one linear dimension;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, and one or more oxyacids of phosphorus selected from orthophosphoric acid, condensed phosphoric acid, phosphorous acid and hypophosphorous acid;

(C) from the beginning of the spontaneous chemical reaction described in (III) below, a third mass of oxidizing agent, wherein the oxidizing stoichiometric equivalent as hydrogen peroxide of said third mass has a molar ratio to said non-powdery mass of predominantly elemental nickel reagent that is from about 0.80:1.00 to about 1.6:1.00; and, optionally, (D) dissolved nickel cations, wherein (a) at least 80%, based on weight, of the acid content of said second mass consists of one or more oxyacids of phosphorus, and (b) at the beginning of the spontaneous chemical reaction described in (III) below (1) the concentration of the oxyacid or oxyacids of phosphorus, measured as their stoichiometric equivalent as orthophosphoric acid, is from about 30 to about 55%, based on weight, of said second mass; and (2) the mass of the oxyacid or oxyacids of phosphorus, measured as their stoichiometric equivalent as orthophosphoric acid, in said second mass has a ratio, based on weight, to the mass of nickel in said first mass that is from about 3.0:1.00 to about 7.0:1.00; and (III) effecting contact between said first mass and said second mass under such conditions of temperature and relative motion between said two masses as will result in spontaneous chemical reaction between them, said spontaneous chemical reaction converting at least 80 percent, by weight, of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours.

2. A process according to claim 1 which is a batchwise process and during operation (III) of which:

there is an initial temperature at the time of beginning said spontaneous chemical reaction that is from about 15 to about 31° C.;

there is a maximum temperature that is from about 65 to about 95° C.; and the temperature is controlled so that:

the temperature rises from the initial value to the maximum value in increments that are from about 2.0 to about 10° C.;

after the temperature target for each incremental increase has been attained, the temperature is not raised again by external heating for a time interval that is at least about 8 minutes and, unless the target temperature is at least 55° C., is not more than 35 minutes; and after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 $\mu$m in diameter.

3. A process as claimed in claim 1 wherein the oxidizing agent is selected from hydrogen peroxide, ozone or a combination thereof.

4. A process for making a final aqueous acidic liquid that contains dissolved nickel cations, said process comprising the following operations:

(I) providing a first mass of a solid, predominantly elemental nickel reagent, wherein at least 97%, by volume, of said predominantly elemental nickel reagent passes through channels with a diameter of at least 0.30 mm;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, and one or more oxyacids of phosphorous selected from orthophosphoric acid, condensed phosphoric acid, phosphorous acid and hypophosphorous acid, and, optionally, (C) dissolved nickel cations, wherein (a) at least 80%, by weight, of the acid content of said second mass consists of one or more oxyacids of phosphorus, (b) at the beginning of the spontaneous chemical reaction described in (III) below (1) the concentration of the oxyacid or oxyacids of phosphorus, measured as their stoichiometric equivalent as orthophosphoric acid, is from about 30 to about 55%, by weight, of said second mass; and (2) the mass of the oxyacid or oxyacids of phosphorus, measured as their stoichiometric equivalent as orthophosphoric acid, in said second mass has a ratio, based on weight, to the mass of nickel in said first mass that is from about 3.0:1.00 to about 7.0:1.00; and (III) effecting contact between said first mass and said second mass under such conditions of temperature and relative motion between said two masses as will result in spontaneous chemical reaction between them, said spontaneous chemical reaction converting at least 95 percent, by weight, of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours, and (IV) after at least 95%, by weight, but less than all of said first mass has been dissolved, adding to the resulting aqueous acidic liquid a number of moles of a component of oxidizing agent distinct from said non-oxidizing acid, said number of moles of added oxidizing agent component having a ratio to the number of moles of predominantly elemental nickel reagent remaining undissolved at the time of addition that is from about 0.6:1.00 to about 6:1.00, and contact between the thus modified aqueous acidic liquid and the residue of undissolved predominantly elemental nickel reagent is maintained for a time interval that is from about 15 minutes to about 4 hours.

5. A process according to claim 4 which is a batchwise process and during operation (III) of which:

there is an initial temperature at the time of beginning said spontaneous chemical reaction that is from about 15 to about 31° C.;

there is a maximum temperature that is from about 65 to about 95° C.; and the temperature is controlled so that:

the temperature rises from the initial value to the maximum value in increments that are from about 2.0 to about 10° C.;

after the temperature target for each incremental increase has been attained, the temperature is not raised again by external heating for a time interval that is at least about 8 minutes and, unless the target temperature is at least 55° C., is not more than 35 minutes; and after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 $\mu$m in diameter.

6. A process as claimed in claim 4 wherein the oxidizing agent is selected from hydrogen peroxide, ozone or a combination thereof.

7. A process for making a final aqueous acidic liquid that contains dissolved nickel cations, said process comprising the following operations:

(I) providing a first mass of a solid, predominantly elemental nickel reagent, comprising a non-powdery mass in which each individual piece of said predominantly elemental nickel reagent is longer than about 0.5 mm in at least one linear dimension;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, and one or more oxyacids of phosphorus selected from orthophosphoric acid, condensed phosphoric acid, phosphorous acid and hypophosphorous acid, wherein at least 80%, by weight, of the acid content thereof comprises hydrofluoric acid, and wherein at the beginning of the spontaneous chemical reaction described in (III) below (1) the concentration of the hydrofluoric acid is from about 5.0 to about 40%, by weight, of said second mass; and (2) the mass of the hydrofluoric acid in said second mass has a ratio to the mass of nickel in said first mass that is from about 0.60:1.00 to about 3.0:1.00;

(C) from the beginning of the spontaneous chemical reaction described in (III) below, a third mass of oxidizing agent, wherein the oxidizing stoichiometric equivalent as hydrogen peroxide of said third mass has a molar ratio to said non-powdery mass of predominantly elemental nickel reagent that is from about 0.80:1.00 to about 1.6:1.00; and, optionally, (D) dissolved nickel cations; and (III) effecting contact between said first mass and said second mass under such conditions of temperature and relative motion between said two masses as will result in spontaneous chemical reaction between them, said spontaneous chemical reaction converting at least 80 percent, by weight, of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours.

8. A process according to claim 7 which is a batchwise process and during operation (III) of which:

there is an initial temperature at the time of beginning said spontaneous chemical reaction that is from about 15 to about 31° C.;

there is a maximum temperature that is from about 65 to about 95° C.; and the temperature is controlled so that:

the temperature rises from the initial value to the maximum value in increments that are from about 2.0 to about 10° C.;

after the temperature target for each incremental increase has been attained, the temperature is not raised again by external heating for a time interval that is at least about 8 minutes and, unless the target temperature is at least 55° C., is not more than 35 minutes; and after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 μm in diameter.

9. A process as claimed in claim 7 wherein the oxidizing agent is selected from hydrogen peroxide, ozone or a combination thereof.

10. A process for making a final aqueous acidic liquid that contains dissolved nickel cations, said process comprising the following operations:

(I) providing a first mass of a solid, predominantly elemental nickel reagent, wherein at least 97%, by volume, of said predominantly elemental nickel reagent passes through channels with a diameter of at least 0.30 mm;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, and one or more oxyacids of phosphorus selected from orthophosphoric acid, condensed phosphoric acid, phosphorous acid and hypophosphorous acid, wherein at least 80%, by weight, of the acid content thereof comprises hydrofluoric acid, and wherein at the beginning of the spontaneous chemical reaction described in (III) below (1) the concentration of the hydrofluoric acid is from about 5.0 to about 40%, by weight, of said second mass; and (2) the mass of the hydrofluoric acid in the second mass has a ratio to the mass of nickel in said first mass that is from about 0.60:1.00 to about 3.0:1.00; and, (C) optionally, dissolved nickel cations;

(III) effecting contact between said first mass and said second mass under such conditions of temperature and relative motion between said two masses as will result in spontaneous chemical reaction between them, said spontaneous chemical reaction converting at least 95 percent, by weight, of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours, and (IV) after at least 95%, by weight, but less than all of said first mass has been dissolved, adding to the resulting aqueous acidic liquid a number of moles of a component of oxidizing agent, said number of moles of added oxidizing agent component having a ratio to the number of moles of predominantly elemental nickel reagent remaining undissolved at the time of addition that is from about 0.6:1.00 to about 6:1.00, and contact between the thus modified aqueous acidic liquid and the residue of undissolved predominantly elemental nickel reagent is maintained for a time interval that is from about 15 minutes to about 4 hours.

11. A process according to claim 10 which is a batchwise process and during operation (III) of which:

there is an initial temperature at the time of beginning said spontaneous chemical reaction that is from about 15 to about 31° C.;

there is a maximum temperature that is from about 65 to about 95° C.; and the temperature is controlled so that:

the temperature rises from the initial value to the maximum value in increments that are from about 2.0 to about 10° C.;

after the temperature target for each incremental increase has been attained, the temperature is not raised again by external heating for a time interval that is at least about 8 minutes and, unless the target temperature is at least 55° C., is not more than 35 minutes; and after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 μm in diameter.

12. A process as claimed in claim 10 wherein the oxidizing agent is selected from hydrogen peroxide, ozone or a combination thereof.

13. A process for making a final aqueous acidic liquid that contains dissolved nickel cations, said process comprising the following operations:

(I) providing a first mass of a solid, predominantly elemental nickel reagent, comprising a non-powdery mass in which each individual piece of said predominantly elemental nickel reagent is longer than about 0.5 mm in at least one linear dimension;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, and one or more oxyacids of phosphorus selected from orthophosphoric acid, condensed phosphoric acid, phosphorus acid and hypophosphorous acid;

(C) from the beginning of the spontaneous chemical reaction described in (III) below, a third mass of oxidizing agent, wherein the oxidizing stoichiometric equivalent as hydrogen peroxide of said third mass has a molar ratio to said non-powdery mass of predominantly elemental nickel reagent that is from about 0.80:1.00 to about 1.6:1.00; and, optionally, (D) dissolved nickel cations; and;

(III) effecting contact between said first mass and said second mass under such conditions of temperature and relative motion between said two masses as will result in spontaneous chemical reaction between them, said spontaneous chemical reaction converting at least 80 percent, by weight, of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours.

14. A process according to claim 13 which is a batchwise process and during operation (III) of which:

there is an initial temperature at the time of beginning said spontaneous chemical reaction that is from about 15 to about 31° C.;

there is a maximum temperature that is from about 65 to about 95° C.; and the temperature is controlled so that:

the temperature rises from the initial value to the maximum value in increments that are from about 2.0 to about 10° C.;

after the temperature target for each incremental increase has been attained, the temperature is not raised again by external heating for a time interval that is at least about 8 minutes and, unless the target temperature is at least 55° C., is not more than 35 minutes; and after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 $\mu$m in diameter.

15. A process as claimed in claim 13 wherein the oxidizing agent is selected from hydrogen peroxide, ozone or a combination thereof.

16. A process for making a final aqueous acidic liquid that contains dissolved nickel cations, said process comprising the following operations:

(I) providing a first mass of predominantly elemental nickel reagent, wherein at least 97%, by volume, of said predominantly elemental nickel reagent passes through channels with a diameter of at least 0.30 mm;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, orthophosphoric acid, condensed phosphoric acid, phosphorous acid and hypophosphorous acid; and, optionally, (C) dissolved nickel cations;

(III) effecting contact between said first mass and said second mass under such conditions of temperature and relative motion between said two masses as will result in spontaneous chemical reaction between them, said spontaneous chemical reaction converting at least 95 percent of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours.

(IV) after at least 95%, by weight, but less than all of said first mass has been dissolved, adding to the resulting aqueous acidic liquid a number of moles of a component of oxidizing agent, said number of moles of added oxidizing agent component having a ratio to the number of moles of predominantly elemental nickel reagent remaining undissolved at the time of addition that is from about 0.6:1.00 to about 6:1.00, and contact between the thus modified aqueous acidic liquid and the residue of undissolved predominantly elemental nickel reagent is maintained for a time interval that is from about 15 minutes to about 4 hours.

17. A process according to claim 16 which is a batchwise process and during operation (III) of which:

there is an initial temperature at the time of beginning said spontaneous chemical reaction that is from about 15 to about 31° C.;

there is a maximum temperature that is from about 65 to about 95° C.; and the temperature is controlled so that:

the temperature rises from the initial value to the maximum value in increments that are from about 2.0 to about 10° C.;

after the temperature target for each incremental increase has been attained, the temperature is not raised again by external heating for a time interval that is at least about 8 minutes and, unless the target temperature is at least 55° C., is not more than 35 minutes; and after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 $\mu$m in diameter.

18. A process as claimed in claim 16 wherein the oxidizing agent is selected from hydrogen peroxide, ozone or a combination thereof.

19. A batchwise process for making a final aqueous acidic liquid that contains dissolved nickel cations, said process comprising the following operations:

(I) providing a first mass of a predominantly elemental nickel reagent;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, phosphorous acid, condensed phosphorous acids, orthophosphoric acid, and condensed phosphoric acids, wherein at least 80%, by weight, of the acid content of said second mass consists of hydrofluoric acid; and, optionally, one or both of the following components:

(C) an oxidizing agent component that contains molecules of at least one oxidizing agent; and (D) dissolved nickel cations; and (III) effecting contact between said first mass and said second mass under such conditions of temperature and relative motion between said two masses as will result in spontaneous chemical reaction between them, said spontaneous chemical reaction converting at least 80 percent, by weight, of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours, wherein (a) at the beginning of said spontaneous chemical reaction:

(i) the concentration of hydrofluoric acid is from about 5.0 to about 40% of said second mass;

(ii) the mass of the hydrofluoric acid in said second mass has a ratio to the mass of nickel in said first mass that is from about 0.60:1.00 to about 3.0:1.00; and (iii) the initial temperature is from about 15 to about 31° C.

(b) during operation (III)

(i) there is a maximum temperature that is from about 65 to about 95° C.;

(ii) the temperature is controlled so that:

(aa) the temperature rises from the initial value to the maximum value in increments that are from about 2.0 to about 10° C.;

(bb) after the temperature target for each incremental increase has been attained, the temperature is not raised again by external heating for a time interval that is at least about 8 minutes and, unless the target temperature is at least 55° C., is not more than 35 minutes; and (cc) after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 $\mu$m in diameter.

20. A process as claimed in claim 19 wherein the oxidizing agent is selected from hydrogen peroxide, ozone or a combination thereof.

21. A batchwise process for making a final aqueous acidic liquid that contains dissolved nickel cations, said process comprising the following operations:

(I) providing a first mass of a predominantly elemental nickel reagent;

(II) providing, separately from said first mass, a second mass of a precursor aqueous acidic liquid reagent that comprises the following components:

(A) water;

(B) molecules of at least one non-oxidizing acid selected from a group consisting of formic acid, acetic acid, sulfuric acid, hydrochloric acid, hydrobromic acid, hydriodic acid, hydrofluoric acid, phosphorous acid, condensed phosphorous acids, orthophosphoric acid, and condensed phosphoric acids, optionally, one or both of the following components:

(C) an oxidizing agent component that contains molecules of at least one oxidizing agent; and (D) dissolved nickel cations; and (III) effecting contact between said first mass and said second mass under such conditions of temperature and relative motion between said two masses as will result in spontaneous chemical reaction between them, said spontaneous chemical reaction converting at least 80 percent, by weight, of the elemental nickel present in said first mass to dissolved nickel cations in a final aqueous acidic liquid that includes some of the molecules of non-oxidizing acid originally present in said second mass within a time interval, beginning with the first contact between said first and second masses, that is not more than 24 hours, wherein (a) at the beginning of said spontaneous chemical reaction, the initial temperature is from about 15 to about 31° C.; and (b) during operation (III)

(i) there is a maximum temperature that is from about 65 to about 95° C.;

(ii) the temperature is controlled so that:

(aa) the temperature rises from the initial value to the maximum value in increments that are from about 2.0 to about 10° C.;

(bb) after the temperature target for each incremental increase has been attained, the temperature is not raised again by external heating for a time interval that is at least about 8 minutes and, unless the target temperature is at least 55° C., is not more than 35 minutes; and (cc) after the aqueous acidic liquid has reached the maximum temperature, this temperature is maintained for a time interval from 2.0 to 10 hours, after which time interval the final acidic aqueous liquid is cooled to a temperature from 24 to 40° C. and filtered through a filter that retains particles that are as much as 4 $\mu$m in diameter.

22. A process as claimed in claim 21 wherein the oxidizing agent is selected from hydrogen peroxide, ozone or a combination thereof.

* * * * *